US005984449A

United States Patent [19]

Tajika et al.

[11] Patent Number: 5,984,449

[45] Date of Patent: Nov. 16, 1999

[54] INK JET RECORDING BY SUPERIMPOSING INKS OF DIFFERENT DENSITIES

[75] Inventors: Hiroshi Tajika; Noribumi Koitabashi, both of Yokohama; Atsushi Arai, Kasukabe; Hiromitsu Hirabayashi, Yokohama, all of Japan

[73] Assignee: Canon Kabushiki Kaisha, Tokyo, Japan

[21] Appl. No.: 08/187,139

[22] Filed: Jan. 27, 1994

Related U.S. Application Data

[63] Continuation of application No. 07/860,212, Mar. 27, 1992, abandoned, which is a continuation of application No. 07/498,279, Mar. 23, 1990, abandoned.

[30] Foreign Application Priority Data

| | | | |
|---|---|---|---|
| Mar. 24, 1989 | [JP] | Japan | 1-73019 |
| Mar. 24, 1989 | [JP] | Japan | 1-73020 |
| Mar. 20, 1990 | [JP] | Japan | 2-68199 |

[51] Int. Cl.[6] ..... B41J 2/01

[52] U.S. Cl. ..... 347/15; 347/43

[58] Field of Search ..... 346/140 R, 75; 347/24, 15, 43

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,528,576 | 7/1985 | Koumura et al. | 364/140 R |
| 4,558,333 | 12/1985 | Sugitani et al. | 346/140 |
| 4,560,997 | 12/1985 | Sato et al. | 346/140 |
| 4,604,654 | 8/1986 | Sakurada et al. | 358/298 |
| 4,631,578 | 12/1986 | Sasaki et al. | 358/80 |
| 4,635,078 | 1/1987 | Sakurada et al. | 346/140 R |
| 4,672,432 | 6/1987 | Sakurada et al. | 358/75 |
| 4,682,216 | 7/1987 | Sasaki et al. | 358/79 |
| 4,686,538 | 8/1987 | Kouzato | 346/1.1 |
| 4,692,773 | 9/1987 | Saito et al. | 346/1.1 |
| 4,713,701 | 12/1987 | Kawamura et al. | 358/298 |
| 4,713,746 | 12/1987 | Watanabe et al. | 346/1.1 |
| 4,714,964 | 12/1987 | Sasaki | 358/298 |
| 4,723,129 | 2/1988 | Endo et al. | 346/1.1 |
| 4,727,436 | 2/1988 | Kawamura | 358/298 |
| 4,740,796 | 4/1988 | Endo et al. | 346/1.1 |
| 4,772,911 | 9/1988 | Sasaki et al. | 346/140 R |
| 4,860,026 | 8/1989 | Matsumoto et al. | 346/1.1 |
| 4,952,942 | 8/1990 | Kanome et al. | 346/1.1 |
| 4,959,659 | 9/1990 | Sasaki et al. | 346/1.1 |

FOREIGN PATENT DOCUMENTS

| | | | |
|---|---|---|---|
| 0259541 | 3/1988 | European Pat. Off. | 347/15 |
| 3401071 | 7/1985 | Germany . | |
| 57-63285 | 4/1982 | Japan | 346/140 R |
| 59-123670 | 7/1984 | Japan . | |
| 59-138461 | 8/1984 | Japan . | |
| 59-198162 | 11/1984 | Japan . | |
| 60-151061 | 8/1985 | Japan . | |
| 60-262663 | 12/1985 | Japan . | |
| 61-25854 | 2/1986 | Japan | 346/140 R |
| 61-054943 | 3/1986 | Japan . | |
| 61-108254 | 5/1986 | Japan . | |
| 64-75252 | 3/1989 | Japan . | |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

This invention is a recording head cartridge which includes a plurality of inks having a density difference for an ink of one color, includes recording heads on a single substrate or in an adjacent aligned state, and integrates ink tanks for the plurality of inks, so as to reliably perform gradation recording while achieving a simple control circuit, and improvement in operability upon replacement. This invention also provides a structure in which ink tanks in the cartridge are integrated to determine a light/depth printing order, and have different volumes so as to improve advantages of replacement.

15 Claims, 8 Drawing Sheets

INK JET RECORDING BY SUPERIMPOSING INKS OF DIFFERENT DENSITIES

This application is a continuation of application Ser. No. 07/860,212 filed Mar. 27, 1992, now abandoned, which in turn is a continuation of application Ser. No. 07/498,279 filed Mar. 23, 1990, now abandoned.

BACKGROUND OF THE INVENTION

1. Field of the Invention

The present invention relates to a recording head cartridge which integrates an ink-jet recording head and an ink storing unit for storing an ink to be supplied to the recording head.

2. Description of the Related Art

Recording apparatuses ordinarily used in printers or facsimile systems perform recording on the basis of binary recording data indicating whether or not a dot is present on a pixel. When an original image having many different density levels such as a photograph, a print, a painting, or the like is to be reproduced, any difference between the densities of dots forming a recording image becomes conspicuous, and the image exhibits graininess. In particular, in a highlight portion, this tendency is considerable.

For this reason, an ink-jet recording apparatus of a density multi-value recording system using light and deep inks, and capable of converting the densities of dots to be jetted to a recording medium into multi-values is proposed. According to the density multi-value recording system, when binary data expressing a density is merely converted to three-value data, gradation of a recording image, in particular, gradation of a highlight portion is improved, and graininess caused by dots can be eliminated. As a result, image quality of a recording image can be improved.

In an ink-jet recording apparatus, a proposal has been made for solving a problem caused by an arrangement wherein a recording head for discharging an ink, and an ink storing unit (to be simply referred to as an ink tank hereinafter) are separately arranged. More specifically, since an ink tube or the like is used to supply an ink from the ink tank to the recording head, dust or air enters through connecting portions or the like of this tube, and becomes dust or bubbles in an ink, thus posing a problem of impaired stability of ink discharge. In addition, a cumbersome operation is required to connect a supply tube when the ink tank or the recording head is replaced, and it is difficult to prevent the entrance of bubbles into the ink upon tank or head replacement. Thus, in order to prevent these problems, a recording head cartridge which integrates the recording head and the ink tank has been proposed.

The recording head cartridge is also especially attractive in view of the fact that latest recording heads can be mass-produced at low cost by the same processes used in semiconductor device manufacturing processes. More specifically, with this integrated structure, when the supply of ink is exhausted, the old cartridge is replaced with a new recording head cartridge integrated with a recording head, and the old recording head and ink tank can be disposed.

In the density multi-value recording system using the above-mentioned ink-jet recording apparatus, the dot size of the light and deep inks, the pitches of light and deep ink dots, the dye densities of the light and deep inks, and the like are optimized, thereby decreasing the dye density of the light ink as much as possible. The dye density of the deep ink is increased to increase an optical density, and a density jump occurring at an interface between the light and deep inks is prevented while improving gradation.

Recording systems are known which can satisfy the above-mentioned requirements, using a method wherein a dark ink having a higher dye density is jetted first, then the dye density is sequentially lowered, and finally, a light ink having a lowest dye density is jetted. With this method, a high-gradation, high-resolution, and high-quality image free from graininess can be obtained.

However, when full-color recording is performed by the above-mentioned recording head cartridge arrangement, two types of, i.e., light and deep ink cartridges must be prepared for each of cyan (C), magenta (M), yellow (Y), and black (B) inks, and a carriage which carries a total of eight cartridges to perform scanning movement for recording becomes large in size.

Since recording head cartridges for light and deep inks cannot be integrated with each other, when light and deep ink cartridges of the same color are simultaneously replaced (one ink is rarely used alone), this becomes a cumbersome operation.

Since the operation between an orifice array for discharging a light ink and that for discharging a deep ink inevitably becomes large, a long period of time is required after the deep ink is discharged until the light ink is discharged. In order to perform synchronization between recording data sent from a host apparatus or the like and ink discharge during this period of time, the capacity of a buffer memory for temporarily storing these data must be increased, and cost of the entire apparatus is increased.

Since the separation between the orifice arrays is large, when light and deep inks are jetted to overlap each other, the light ink often overlaps the deep ink after the deep ink is absorbed. In this case, graininess caused by deep ink dots appears, and the image quality of the density multi-value recording system is compromised.

Furthermore, as for the separation between the orifice arrays, since the light and deep ink cartridges are not integrated, as described above, the separation therebetween may be changed upon replacement of cartridges, and this change comprises image quality of a recorded image.

When such recording is performed, it is well known to use the light ink used as frequently as is possible in order to obtain a high-gradation, high-resolution image free from graininess. Therefore, when high image quality of the density multi-value recording system and a cartridge structure of a recording head and an ink tank in consideration of operability are realized at the same time, it will be necessary to replace the cartridge for the light ink more frequently than it will be necessary to replace that for the dark ink.

When replacing the light ink cartridge, the deep ink cartridge must also be replaced (the deep ink is rarely used alone), resulting in waste of the cartridge, which still contains ink.

In order to avoid such waste, a cartridge may have a light ink tank having an increased tank volume. With this structure, however, a difference in tank shape causes a difference in the distance between the heads (the distance between the discharge ports) of the light and deep inks, and the capacity of a buffer memory for performing synchronization between a supply timing of recording data and an ink discharge timing must be further increased, thus posing a new problem.

When a volume difference is compensated for by a flexible ink tank, the cartridges cannot be moved with precision upon recording, and this structure impairs an easy handling feature of the cartridge.

SUMMARY OF THE INVENTION

The present invention has been made in consideration of the above-mentioned problems, and has as an object the provision of a recording head cartridge wherein light and deep ink cartridges are integrated to shorten distances between their corresponding orifices, thereby providing a recording head more suitable for a density multi-value recording system, and reduce the overall size of the recording head to improve operability upon replacement.

It is another object of the present invention to provide a recording apparatus wherein a plurality of recording head cartridges for printing recording inks having different densities on a recording medium overlap each other upon movement relative to the recording medium, each of which recording head cartridges comprises a plurality of recording heads having discharge ports for discharging, from the discharge ports, inks having different densities for the same ink color, and a plurality of ink storing units, integrally arranged in correspondence with the plurality of recording heads, for storing inks to be discharged from the corresponding recording heads, are integrally arranged, and are aligned according to an overlapping order of inks.

According to the above arrangement of the recording apparatus, inks to be jetted on the recording medium can overlap each other in the order of higher ink densities, and distances between discharge ports for discharging inks having different densities can be shortened.

Therefore, the discharge separation of inks having different densities can be decreased.

It is still another object of the present invention to provide a recording head in which recording head cartridges corresponding to inks having different densities are integrated, and the volumes of tanks for inks having lower densities are increased, so that cartridges can be replaced without any waste and "operability after replacement can be" improved, and the distance between discharge ports for discharging inks having different densities can be decreased.

For this purpose, according to the present invention, a plurality of recording head cartridges, for performing recording using inks having different densities, each of which comprises a plurality of recording heads for discharging inks having different densities, and ink storing units, integrally arranged in correspondence with the plurality of recording heads, for respectively storing inks to be discharged from the corresponding recording heads, are integrally arranged, and the volumes of the ink storing units are determined in accordance with the respective amounts of inks having different densities used.

According to the above arrangement, a plurality of recording head cartridges corresponding to inks having different densities are integrally arranged, and the volumes of the ink storing units are determined in accordance with amounts of inks having different densities used, so that ink waste can be prevented when replacing the recording head cartridge, and the discharge distance of inks having different densities can be decreased.

DETAILED DESCRIPTION OF THE PREFERRED EMBODIMENTS

An embodiment of the present invention will be described below with reference to the accompanying drawings.

Figure 1:
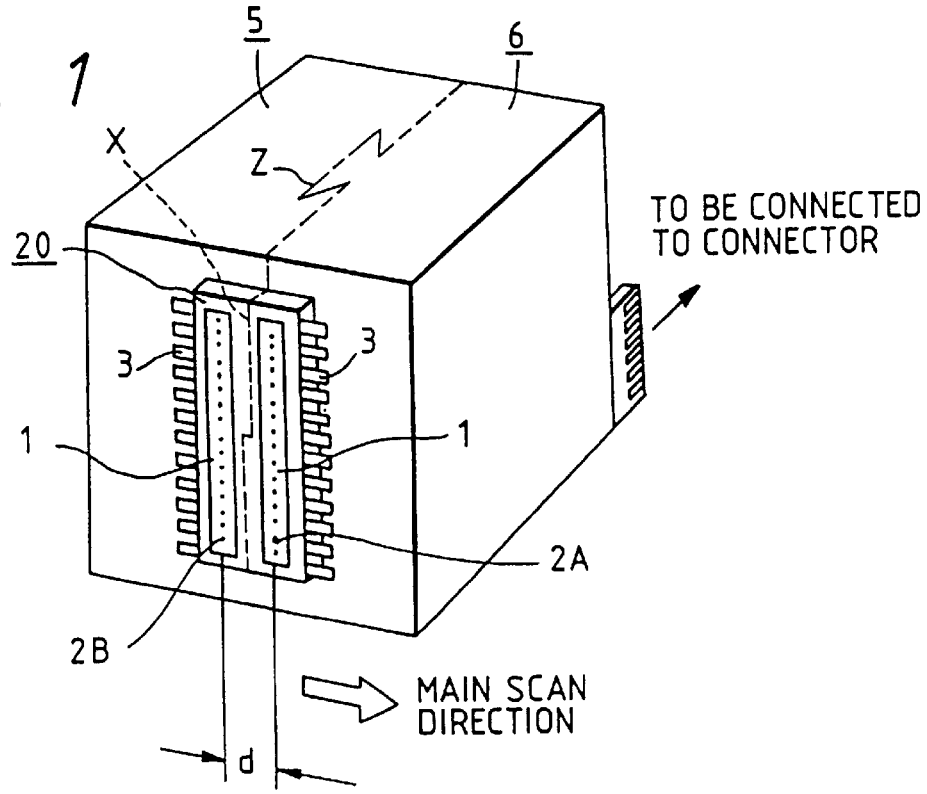
FIG. 1 is a perspective view of an ink-jet recording head cartridge according to an embodiment of the present invention.
Figure 2:
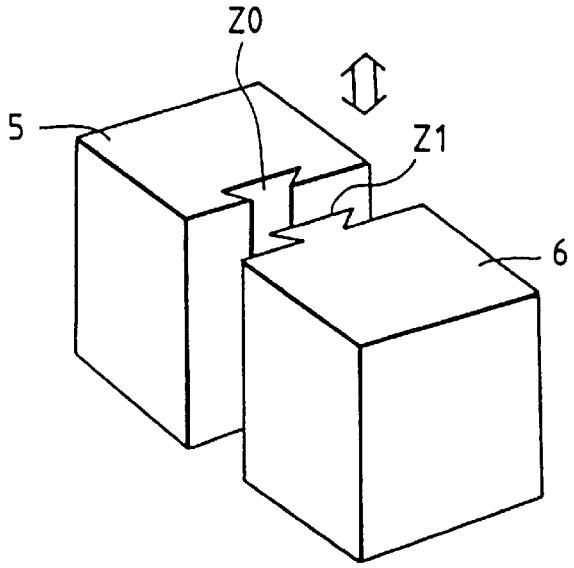
FIG. 2 is a perspective view for explaining a method of integrally arranging ink tanks shown in FIG. 1.

FIG. 1 is a perspective view of a recording head cartridge according to an embodiment of the present invention. In FIG. 1, a plurality of orifices 2 (2A and 2B) are formed as discharge ports for discharging liquid droplet or droplets on orifice plates 1. An ink tank 5 stores an ink of light color or light ink, and an ink tank 6 stores an ink of deep color or deep ink. The light and deep ink tanks 5 and 6 are arranged adjacent to each other.

Each orifice 2 has an ink chamber communicating with it. An electric-heat conversion member for generating heat energy used to discharge an ink is disposed in the ink chamber. A common chamber for supplying ink to the individual ink chambers is arranged on a side of the ink chambers opposite to a side communicating with the orifices 2. The common chamber is supplied with ink through a predetermined supply path from the corresponding neighboring ink tank. Connector pins 3 supply electrical signals according to recording data to the corresponding electric-heat conversion members.

In this embodiment, the light and deep ink tanks 5 and 6 are integrated by a slidable fitting system (by means of a trapezoidal recess portion Z0 of the tank 5 and a trapezoidal projecting portion Z1 of the tank 6). An integrally formed recording head 20 on which the 128 orifices 2A for discharging the deep ink and the 128 orifices 2B for discharging the light ink and which are arrayed in a sub scan direction is mounted on the integrated ink tanks 5 and 6. Although not shown, the above-mentioned common chambers and the supply paths from the ink tanks are separately arranged in correspondence with the light and deep inks.

With the above arrangement, a distance d between corresponding orifices for the light and deep inks in a main scan direction can be shortened, and the recording head cartridge itself can be made more compact. Furthermore, a variation in distance d upon replacement of the cartridge can be suppressed within the range of manufacturing tolerances.

In this embodiment, recording head units (orifice plates) 1 are respectively aligned and fixed to the tanks 5 and 6. For this reason, when a junction portion Z (FIG. 1) is formed upon engagement between the trapezoidal recess and projecting portions Z0 and Z1, stepped portions are brought into slide contact with each other, as indicated by a junction portion X (FIG. 1), and the recording head units 1 are integrated, so that the two heads can be aligned with precision.

Note that in the recording head units 1, light and deep ink chambers and ink supply pipes may be formed on a single substrate, and are inserted in and adhered to holes of the corresponding ink tanks. Thus, various forming methods of the recording head units 1 may be employed.

Figure 3:
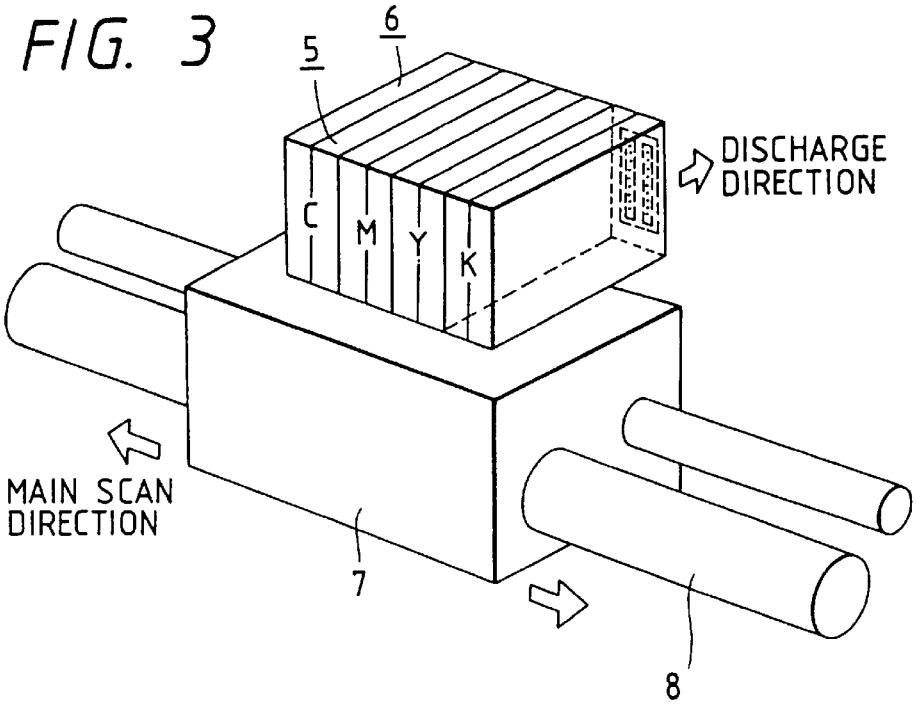
FIG. 3 is a perspective view showing a main part of a recording apparatus to which the recording head cartridge shown in FIG. 1 is applied.

FIG. 3 shows an embodiment wherein the recording head cartridge shown in FIG. 1 is applied to each of C, M, Y, and K color inks to provide recording heads corresponding to full-color recording. As shown in FIG. 3, recording head cartridges each of which integrates light and deep ink tanks in units of color inks are carried on a carriage 7. The carriage 7 is moved in the main scanning direction along a guide shaft 8.

The recording head in each cartridge produces bubbles by heat energy generated by the above-mentioned electric-heat conversion members, and discharges ink droplets according to a change in state of an ink upon a change in bubbles. The orifice diameter of this recording head is 30 $\mu$m. Thus, the diameter of a droplet to be discharged is 30 $\mu$m, and a dot diameter formed by jetting the droplet on a recording medium is 100 $\mu$m. A drive frequency of the recording head is 2.5 kHz, and a n image recording density is 400 dpi.

Furthermore, the dye densities of color inks are set such that Y (light . . . 0.7%, deep . . . 2.0%), C (light . . . 7%, deep . . . 2.5%), M (light . . . 0.6%, deep . . . 2.5%), and K (light . . . 1.0%, deep . . . 3.5%). The order of jetting inks on one pixel is deep→light. In addition, the order of jetting the color inks is C→M→Y→K.

In this embodiment, as described above, recording is performed such that a deep ink is discharged first, and then, a light ink is discharged . If the discharge order is reversed, a deep ink dot having a high dye density is spread to overlap a light ink dot having a low dye density, as shown in FIG. 9, and it appears that a large deep ink dot is jetted on a recording medium. As a result, graininess is undesirably emphasized. Thus, in this embodiment, as shown in FIG. 9, a deep ink is discharged first, and then, a light ink is discharged to overlap the deep ink, thus decreasing graininess.

In addition, even in the recording system of this embodiment, if a discharge separations between the light and deep inks is large, as described above, graininess due to the deep ink dots results. In this case, the light and deep ink recording head cartridges are integrated to shorten the distance between orifices of the recording heads for the light and deep inks, thus avoiding emphasized graininess.

This phenomenon varies depending on distribution tables and binarization schemes. In particular, in a region extending from a highlight portion to a middle density portion and requiring high gradation, the effects of this embodiment can be remarkable.

This effect becomes more remarkable as the discharge interval of the light and deep inks is reduced. In this case, the next light ink is jetted preferably on a recording medium such as paper before the previously printed deep ink is absorbed by the paper.

This technique is reliably performed by a drive controller (not shown) of an ink-jet recording apparatus.

Processing executed when the recording apparatus using the recording head cartridges having the above structure converts color video signals or electrical signals from an image scanner into density multi-value signals, and outputs the density multi-value signals will be described below with reference to FIG. 4.

Figure 4:
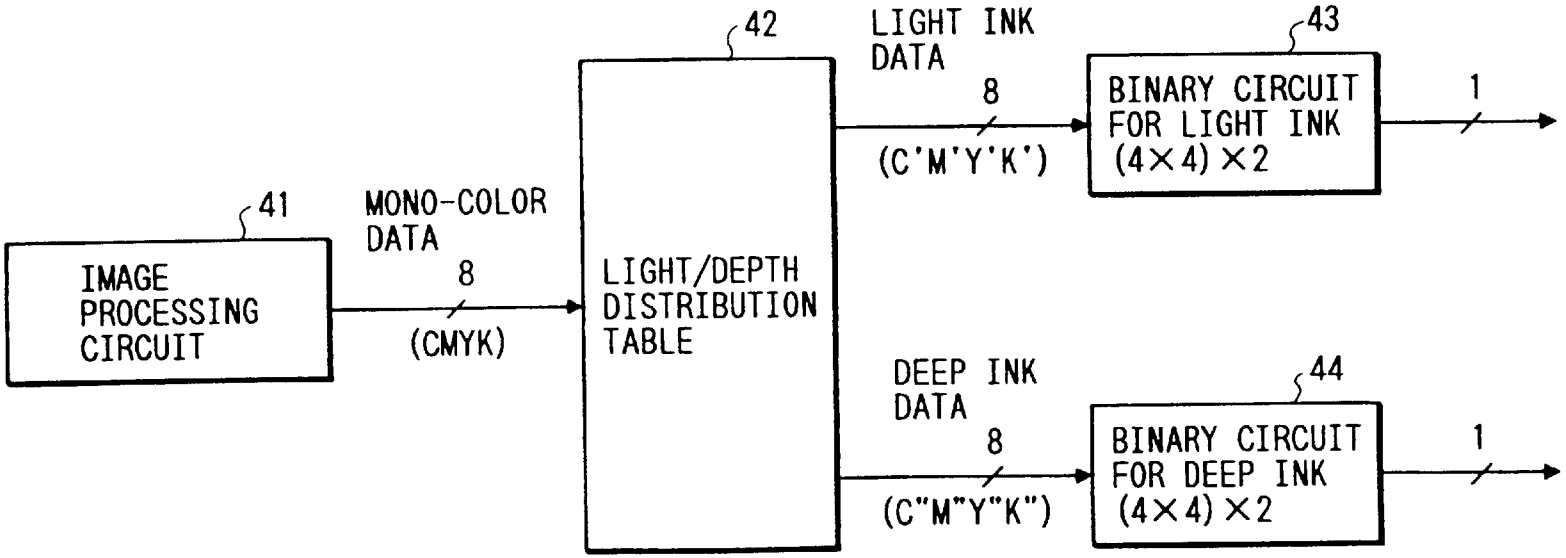
FIG. 4 is a block diagram of an image data processing circuit according to an embodiment of the present invention.

FIG. 4 is a block diagram showing an arrangement for light/depth distribution processing and binarization processing, which is arranged in correspondence with each of color inks Y, M, C, and K. An image processing circuit 41 executes shading correction of RGB signals from a color image scanner or the like, and then executes input masking, logarithmic conversion, and output masking operations, thereby outputting 8-bit mono-color data corresponding to the ink color C. Note that mono-color data for other ink colors M, Y, and K are output from the similar circuits.

The output mono-color data is distributed into light ink data (C') and deep ink data (C") according to a light/depth distribution table 42. Thereafter, the light and deep ink data are respectively binarized by corresponding binary circuits ((4×4)×2 Bayer dither matrices) to be supplied to the recording heads as 1-bit ON/OFF data. In this embodiment, the binary circuit employs a dither method but may employ various other methods, e.g., an error scattering method.

A method of forming the light/depth distribution table shown in FIG. 4 will be described below. Seventeen density levels are set for each of the light and deep inks, and patches of all combinations (17×17 sets) of light inks overlapping deep inks are formed using these inks. Optical densities (OD values) of these patches are then measured by a color analyzer CA-35 (available from Murakami Shikisai-sha). The relationships between combinations of the light and deep inks and optical densities are obtained from the measured results, and a relationship is selected based on this information in which an optical density as output data linearly changes according to a change in mono-color data as input data shown in FIG. 4. Upon this selection, combinations of the light and deep inks corresponding to input data can be determined, and are used in a distribution table.

Figure 5:
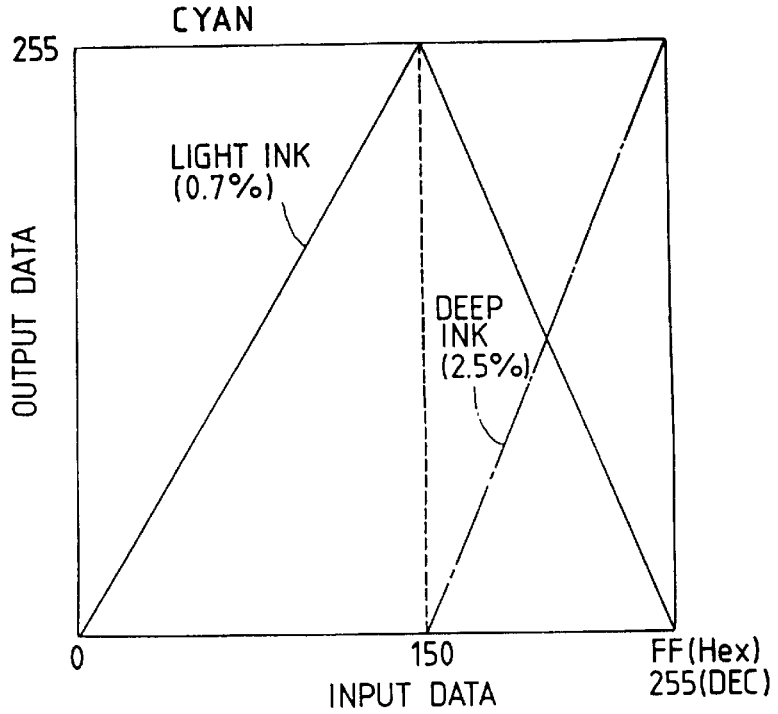
FIG. 5 is a graph showing the principle of a light/depth distribution table shown in FIG. 4.
Figure 9A:
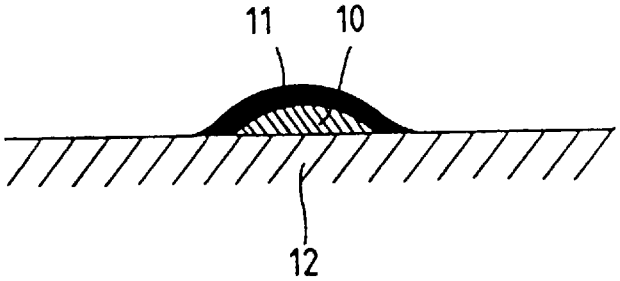
Figure 9B:
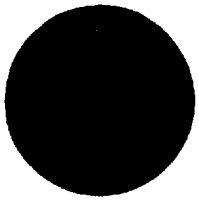

FIG. 5 shows the principle of the distribution table obtained in this manner. FIG. 5 shows the distribution table for the ink color C. In FIG. 5, output data for the light ink as a function of input data is indicated by a solid line, and output data for the deep ink as a function of input data is indicated by an alternate long and short dashed line. As can be seen from this graph, only the light ink is used up to low dye density, as shown in FIGS. 9A and 9B, and it appears the light and deep inks are combined.

Figure 8A:
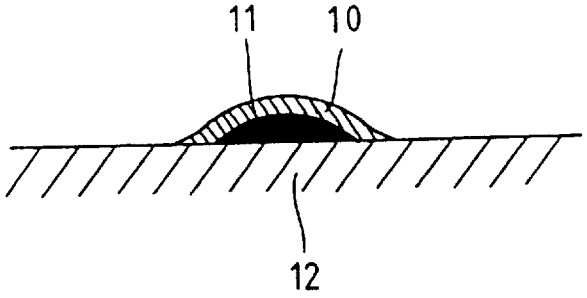
FIGS. 8A and 8B and 9A and 9B are sectional and top views for explaining a difference in image quality depending on overlapping states of inks.
Figure 8B:
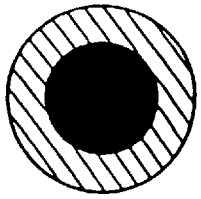

When an image of a color picture (silver chloride) was copied using the above-mentioned arrangement, an FIGS. 8A and 8B, a deep ink is discharged first, and then, a improved gradation on a highlight portion such as a skin portion as compared to a normal binary image could be obtained.

Figure 6:
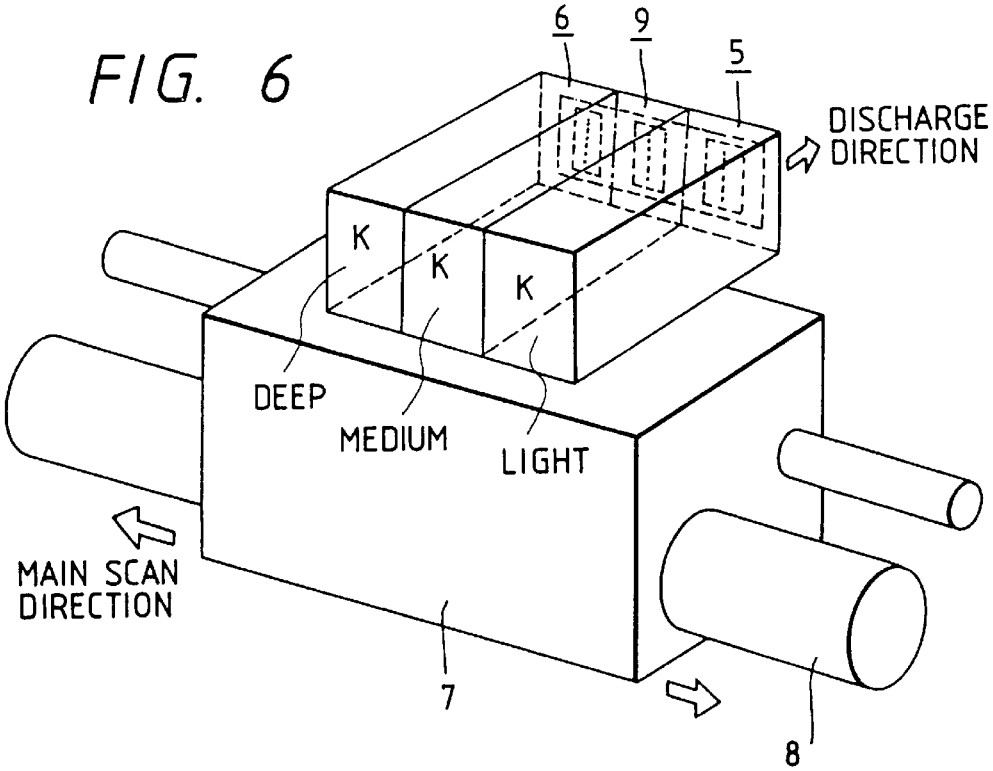
FIG. 6 is a perspective view showing a main part of a recording apparatus according to another embodiment of the present invention.

FIG. 6 shows an ink-jet recording apparatus according to another embodiment of the present invention. This apparatus performs four-value recording of a light ink (0.5%), a medium ink (1.0%), and a deep ink (0.3%) using only a black ink.

In FIG. 6, a light ink cartridge 5, a medium (density) ink cartridge 9, and a deep ink cartridge 6 are integrally arranged so that an ink discharge order from these cartridges is set to be deep→medium→light. Recording head units indicated by a broken line in FIG. 6 have a shorter distance between orifice arrays than in a conventional apparatus, as in the embodiment shown in FIG. 1.

In this structure, Table 1 below summarizes examination results of image quality and graininess by changing the ink discharge order of the deep ink (0.3%), the medium ink (1.0% or 1.5%), and the light ink (0.5%). In Table 1, signs show the following fact respectively. ◎ shows "very good", ○ "good", Δ "not good, but not bad" and x "bad".

TABLE 1

| Discharge Order | | | Evaluation | |
|---|---|---|---|---|
| 1 | 2 | 3 | Image Quality | Graininess |
| 0.5% | 1.5% | 3.0% | Δ | x |
| 3.0% | 0.5% | 1.5% | ○ | x |
| 0.5% | 3.0% | 1.5% | ○ | Δ |
| 1.0% | 3.0% | 0.5% | ○ | ○ |
| 3.0% | 0.5% | 1.0% | ○ | ◎ |
| 3.0% | 1.0% | 0.5% | ◎ | ◎ |

As can be understood from Table 1, when a dye density difference is smaller than 1% like the second and third inks, as shown in two lowest rows in Table 1, even if the discharge order is changed, image quality and graininess are not changed very much. However, as can also be understood from Table 1, when the discharge order of inks having a density difference of 1% or more is changed, evaluations of image quality and graininess are considerably changed.

Therefore, when inks having a dye density difference of 1% or more are jetted, if the order of this embodiment is employed, a noticeable difference in image quality and the like can be obtained as compared to a case in which such a specific order is not employed.

Figure 7:
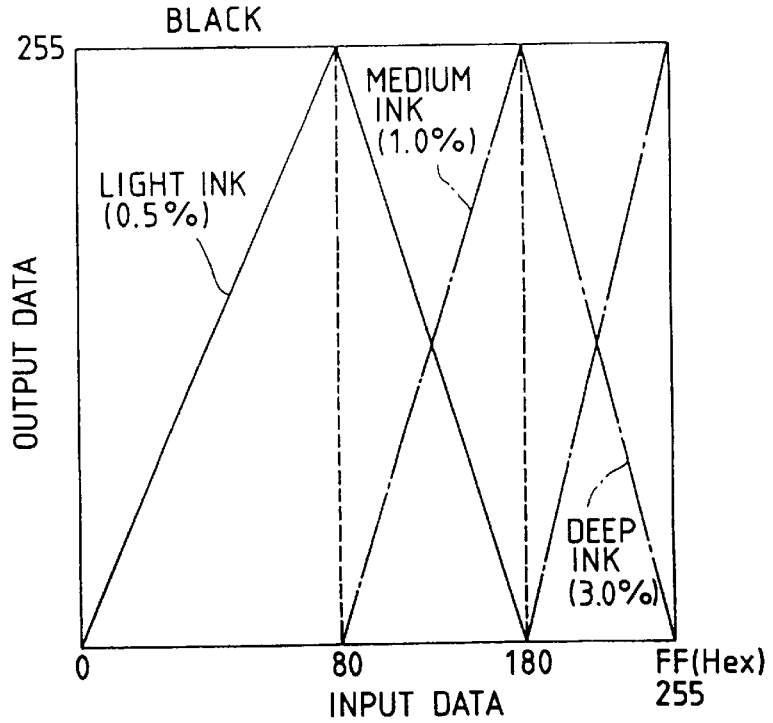
FIG. 7 is a graph showing the principle of a light/depth distribution table in the embodiment shown in FIG. 6.

A light/depth distribution table of this embodiment is created in the same manner as in the above embodiment. This table is shown in FIG. 7.

In this embodiment, recording head cartridges having the same orifice diameters are used. However, recording head cartridges having different orifice diameters may be combined.

All the ink colors do not always require light and deep inks. The number of kinds of inks may be increased/decreased according to the image required.

Furthermore, the recording head used in the embodiments discharges an ink upon production of bubbles by heat energy. However, the present invention is not limited to this. For example, the present invention may be applied to a recording head for discharging an ink using, e.g., a piezoelectric element.

As can be seen from the above description, according to the present invention, inks to be jetted on a recording medium can overlap each other in the order of higher ink densities, and the distance between discharge ports for discharging inks having different densities can be shortened.

Thus, the discharge separation of inks having different densities can be reduced.

As a result, a high-resolution, high-gradation image free from graininess by the density multi-value recording system can be recorded.

Since the discharge separation is reduced, the capacity of the buffer memory can be decreased, and total cost of the apparatus can be reduced.

Since the cartridges are integrated, variations in head discharge position can be reduced, and handling property of the cartridges can be improved.

Another embodiment of the present invention will be described below with reference to FIGS. 10 to 15. Since the embodiment described below has in part the same arrangement as described above, only differences therefrom will be described.

Figure 10:
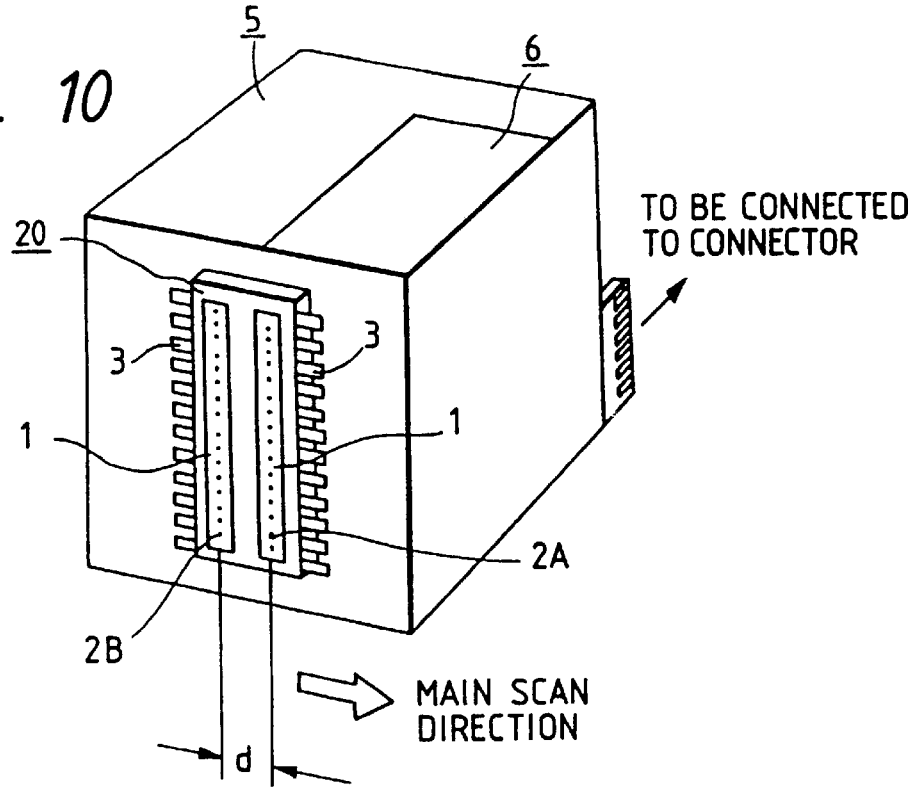
FIG. 10 is a perspective view of an ink-jet recording head cartridge according to another embodiment of the present invention.

FIG. 10 is a perspective view of a recording head cartridge according to another embodiment of the present invention.

Figure 11:
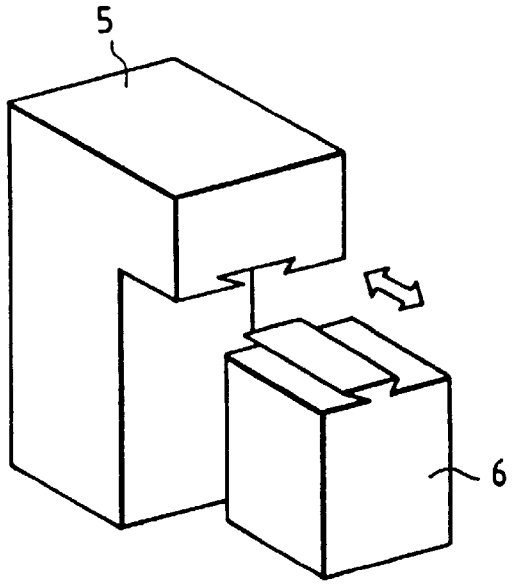
FIG. 11 is a perspective view for explaining a method of integrally arranging an ink tank shown in FIG. 10.

In this embodiment, light and deep ink tanks 5 and 6 are integrated by a slidable fitting system, as shown in FIG. 11. The shapes of the ink tanks are designed so that the volume of the light ink tank 5 is 2.5 times that of the deep ink tank 6. Recording heads 1 of this embodiment are mounted on and fixed to the corresponding tanks through ink supply pipes (not shown) after the tanks are assembled. More specifically, the recording head units 1 are an integrated component in which orifices 2A and 2B are formed on the same substrate.

As has been described above with reference to FIG. 1, a distance d between corresponding ink orifices can be shortened in the main scan direction. The recording head cartridge itself can be rendered compact. In addition, variations in distance d caused by replacement of cartridges can be reduced down to the range of manufacturing tolerances.

Figure 12:
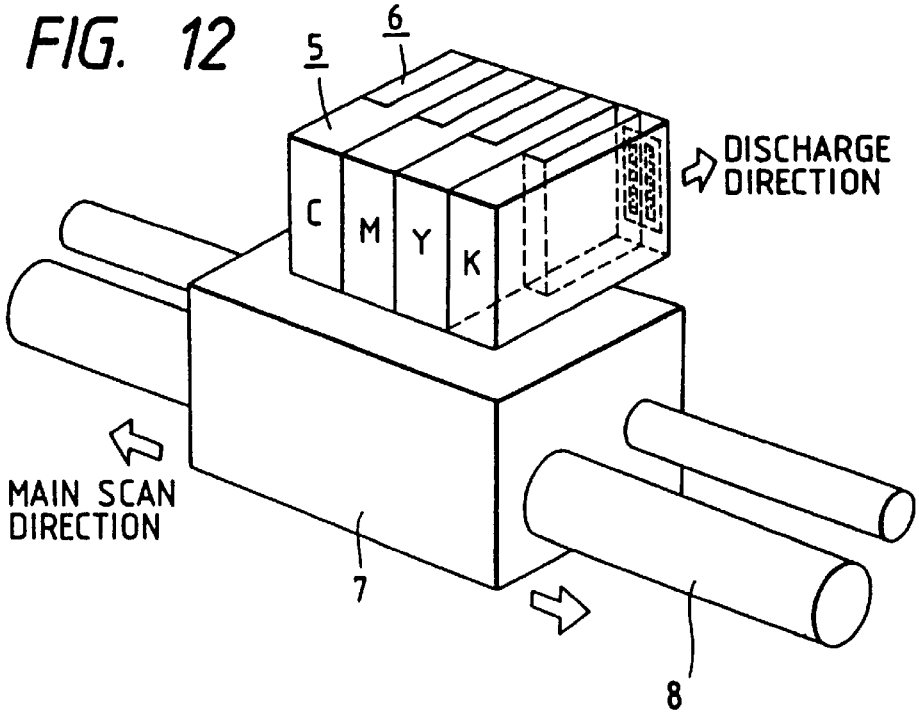
FIG. 12 is a perspective view showing a main part of a recording apparatus to which the recording head cartridge shown in FIG. 10 is applied.

FIG. 12 shows an embodiment wherein the recording head cartridge shown in FIG. 10 is applied to each of C, M, Y, and K color inks to constitute recording heads corresponding to full-color recording. As shown in FIG. 11, recording head cartridges each of which integrates light and deep ink tanks in units of color inks are carried on a carriage 7, and are used in unidirectional printing. The inks and the recording system are the same as those in the embodiment shown in FIG. 1. A ratio of ink discharge (%) based on the block diagram shown in FIG. 4 will be described below with reference to FIG. 13.

Figure 13:
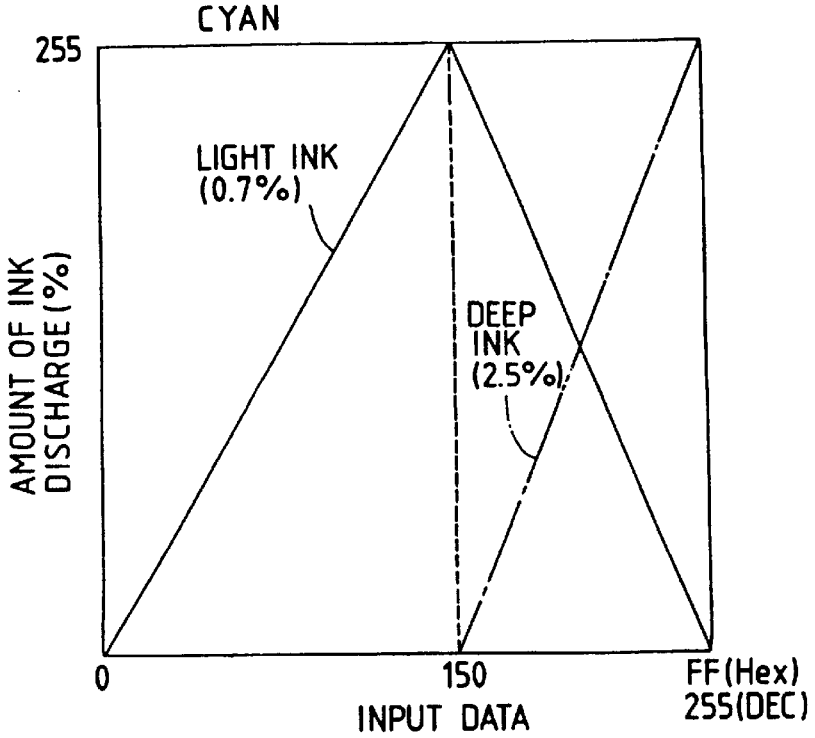
FIG. 13 is a graph showing the principle of a light/depth distribution table shown in FIG. 4 for the cartridge shown in FIG. 10 which is arranged in correspondence with a ratio of ink discharge.

FIG. 13 shows the distribution table for the ink color C. In FIG. 13, output data for the light ink as a function of input data is indicated by a solid line, and output data for the deep ink as a function of input data is indicated by an alternate long and short dashed line. As can be seen from this graph, only the light ink is used up to input data=150, and when the input data exceeds 150, the light and deep inks are combined. It can also be understood that the quantity of the light ink used is more than that of the deep ink, and its ratio is about 1:2.4.

When an image of a color picture (silver chloride) was copied using the above-mentioned arrangement, an image free from graininess and having considerably improved gradation on a highlight portion such as a skin portion as compared to a normal binary image could be obtained.

When an ink consumption durability test (about 250 sheets) using a color chart of the Society of Image Electronics No. 11 was conducted using only a cyan ink, the remaining amount of light ink was about 0.87 cc when a deep cyan ink was used up. In consideration of the fact that the ink amount in the light ink tanks was initially 30.0 cc, the effect of the arrangement in which the volume of the light ink tank is set to be about 2.4 times that of the deep ink tank can be obtained as expected from the table shown in FIG. 13.

Figure 14:
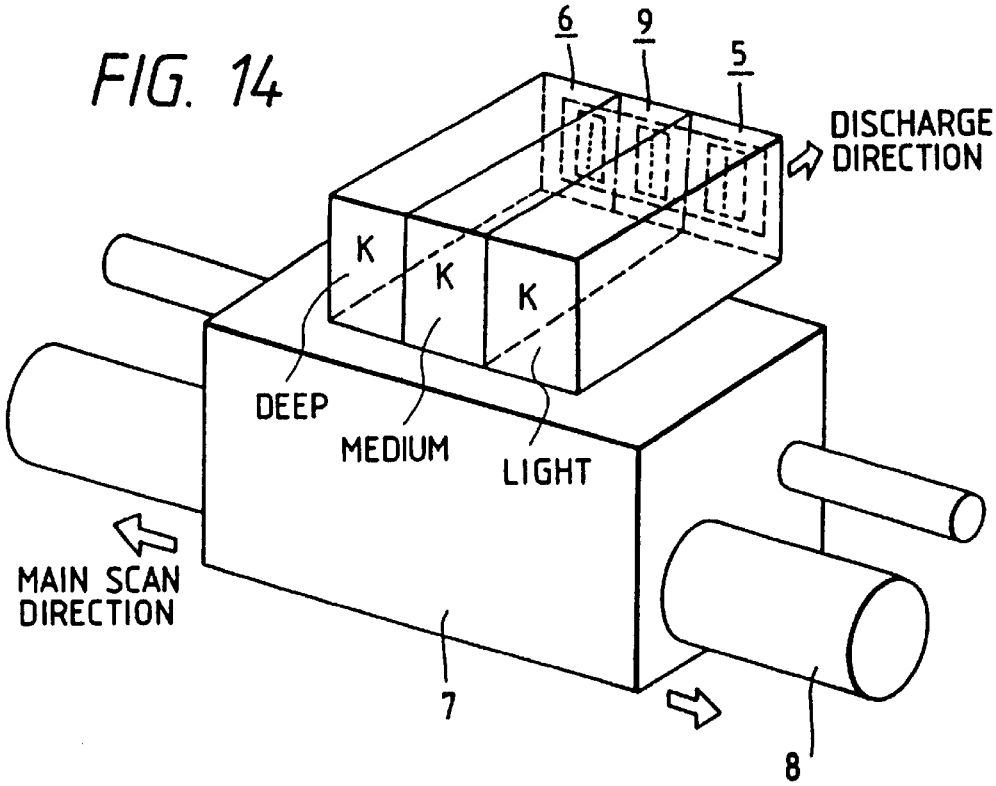
FIG. 14 is a perspective view showing a main part of a recording apparatus according to still another embodiment of the present invention.

FIG. 14 shows an ink-jet recording apparatus according to another embodiment of the embodiment shown in FIG. 10 according to the present invention. This apparatus performs four-value recording of a light ink (0.5%), a medium ink (1.0%), and a deep ink (0.3%) using only a black ink.

In FIG. 6, a light ink cartridge 5 (rectangular prism), a medium (density) ink cartridge 9 (rectangular prism having a recess portion), and a deep ink cartridge 6 (having a shape engaged with the cartridge 9 to define a rectangular prism together with the cartridge 9) are integrally arranged so that an ink discharge order from these cartridges is set to be deep→medium→light. Recording head units indicated by a broken line in FIG. 6 have a shorter distance between orifice arrays than those in a conventional apparatus, as in the embodiment shown in FIG. 1.

Figure 15:
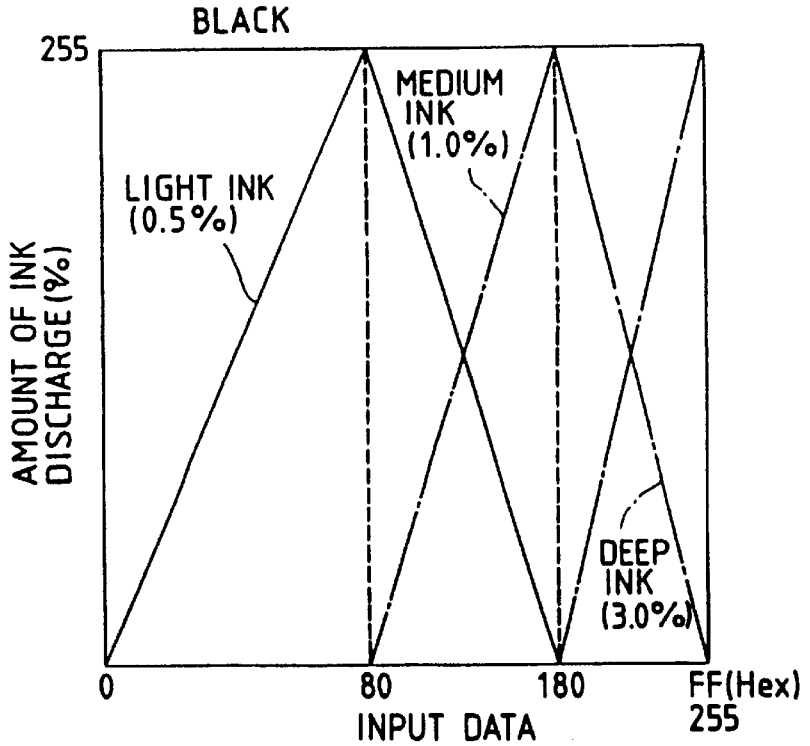
FIG. 15 is a graph showing the principle of a light/depth distribution table in the embodiment shown in FIG. 14 which is arranged in correspondence with a ratio of ink discharge.

A distribution table is created by the same method as in the above embodiment, i.e., 17×17 density levels for light and medium inks, and 17×17 density levels for medium and deep inks. FIG. 15 shows this distribution table.

As can be seen from this graph, the quantities of the light and medium inks used are large, and that of the deep ink is small.

In the apparatus shown in FIG. 14, the volumes of deep, medium, and light ink tanks of the cartridge were set to be 10 cc, 20 cc, and 25 cc, respectively, so that the volume of the ink tank having the maximum dye density was minimized, and recording according to a predetermined chart was performed. As a result, differences in residual ink amounts of the respective densities were small.

However, different results are obtained for a chart having a wide highlight portion, and for an image having a wide solid-black portion. When an image includes a wide highlight portion, the consumption of a light ink is increased. When an image includes a wide solid-black portion, a consumption of the deep ink is increased.

In this manner, when four-value recording using deep, medium, and light inks is performed, images with sastifactory resolution and gradation, i.e., a character to a landscape image including wide halftone portions, can be obtained.

As is apparent from the above description, according to the embodiment of the present invention, a plurality of recording head cartridges corresponding to inks having different densities are integrally arranged, and the volumes of the ink storing units are determined in accordance with amounts of use of inks having different densities, so that ink waste can when replacing the recording head cartridges can be prevented, and the discharge separation of inks having different densities can be decreased.

As a result, operability of the cartridge can be improved, and recording with good image quality can be made.

The present invention can provide an excellent effect that a density balance can be stabilized with high-gradation by the advantage of its dot forming precision, especially, in a bubble-jet recording head and recording apparatus among ink-jet recording systems.

As for the typical arrangement and principle of the bubble-jet recording system, the basic principles disclosed in, e.g., U.S. Pat. Nos. 4,723,129 and 4,740,796 are preferably used. This system can be applied to both the on-demand type and the continuous type. In particular, this system can be advantageously applied to the on-demand type for the following reason. That is, at least one drive signal corresponding to recording information and giving an abrupt temperature rise exceeding nucleate boiling is applied to an electric-heat conversion member arranged in correspondence with a sheet for holding a liquid (ink) or a liquid path to cause the electric-heat conversion member to generate heat energy, thereby causing a heat application surface of a recording head to cause film boiling. A bubble in the liquid (ink) can be consequently formed in a one-to-one correspondence with this drive signal. Upon growth and compression of this bubble, a liquid (ink) is discharged through a discharge opening, thereby forming at least one droplet. If this drive signal consists of pulses, growth and compression of bubbles can be quickly and appropriately performed, and discharge of a liquid (ink) with a particularly short response time can be preferably achieved. As this drive pulse signals, signals described in U.S. Pat. Nos. 4,463,359 and 4,345,262 are suitable. When a condition described in U.S. Pat. No. 4,313,124 associated with a temperature rise rate of the heat application surface is adopted, further excellent recording is allowed.

As the structure of the recording head, the present invention incorporates structures using those described in U.S. Pat. Nos. 4,558,333 and 4,459,600 which disclose structures in which a heat application portion is arranged on a bending region, as well as the structure as a combination of discharge ports, liquid paths, and electric-heat conversion members disclosed in the above-mentioned specifications. In addition, the present invention can be effectively applied to a structure based on Japanese Patent Laid-Open No. 59-123670 which discloses a structure in which a common slit serves as a discharge portion of a plurality of electric-heat conversion members, and to a structure based on Japanese Patent Laid-Open No. 59-138461 which discloses a structure in which an opening for absorbing a pressure wave of heat energy is arranged in correspondence with a discharge portion.

Furthermore, the present invention can also be applied to a full-line type recording head having a length corresponding to a width of a maximum recording medium which can be recorded by a recording apparatus. In this case, the present invention may be applied to a structure in which the length is satisfied by a combination of a plurality of recording heads described in the above-mentioned specifications, or a structure in which the length is satisfied by a single recording head. In these structures, the present invention can further effectively provide the above-mentioned effect.

It is preferable that a recovery means and an auxiliary means are added to a recording head as components of the recording apparatus of the present invention, since the effect of the present invention can be further improved. More specifically, a capping means, a cleaning means, a compression or suction means, a sub heating means comprising electric-heat conversion members, or other heating elements, or a combination of these members, and a means for executing an auxiliary discharge mode for performing discharge different from recording are effectively arranged to the recording head to allow stable recording.

Furthermore, the present invention is not limited to a recording mode using principal colors such as black as a recording mode of the recording apparatus. For example, the present invention can be effectively applied to an apparatus which comprises at least one of a multi-color mode of different colors and a full-color mode by mixing colors by using an integrated recording head or a combination of a plurality of recording heads.

What is claimed is:

1. An ink jet cartridge comprising:

a plurality of recording heads each including a plurality of nozzles arranged in an array along a first direction, said plurality of recording heads being arranged along a second direction; and a plurality of ink tanks each connected to respective ones of said plurality of recording heads, said plurality of ink tanks supplying ink to said plurality of recording heads;

wherein said plurality of recording heads have at least a first recording head which discharges a first ink, said first ink having a first density, and a second recording head which discharges a second ink, said second ink having a second density which is relatively lower than the first density, the first recording head and the second recording head being integrally formed adjacent to each other, and wherein when said first recording head and said second recording head discharge said first ink and said second ink, respectively, discharge of said first ink always precedes discharge of said second ink, with respect to the second direction.

2. An ink jet cartridge according to claim 1, wherein said first recording head and said second recording head always discharge the first ink and the second ink so as to overlap with each other to record in a sequence of said first ink and then said second ink.

3. An ink jet cartridge according to claims 1 or 2, wherein each of a plurality of said ink jet cartridges is arranged attachable to and detachable from the recording apparatus.

4. An ink jet cartridge according to claims 1 or 2, wherein said first ink and said second ink are the same color.

5. An ink jet cartridge according to claims 1 or 2, wherein said first ink and said second ink have different colors.

6. An ink jet cartridge according to claim 5, wherein said first ink is black and said second ink comprises at least one of yellow, cyan and magenta inks.

7. An ink jet cartridge according to claim 4, wherein the ink tank for storing said first ink and an ink tank for storing said second ink are integrally arranged with respect to each other and the ink tank for the second ink has a larger volume.

8. An ink jet cartridge according to claims 1 or 2, wherein the second ink is discharged to overlap onto the first ink before the first ink is absorbed into the recording medium.

9. An ink jet cartridge comprising:

a plurality of recording heads; and a plurality of ink tanks in combination with the plurality of recording heads, the ink tanks for supplying ink to said plurality of recording heads, each of said plurality of recording heads including a nozzle array having a plurality of nozzles arranged in an array along a first direction, and each said recording head being arranged along a second direction, wherein said plurality of recording heads discharge at least black, yellow, magenta and cyan inks, wherein a first tank of said plurality of tanks contains a first ink having a high density, and a second tank of said plurality of tanks contains a second ink having a substantially same color as that of the first ink and a low density, wherein said plurality of recording heads are adjacently positioned and formed integrally with each other for use, and wherein said first ink and said second ink are discharged and overlapped to record on a recording medium in a sequence of said first ink having the high density and said second ink having the low density with respect to the second direction.

10. An ink jet cartridge according to claim 9, wherein a volume of said ink tank for storing said low density ink is larger than that of said ink tank for storing said high density ink.

11. An ink jet cartridge according to claim 10, wherein a volume of said ink tank for storing said low density ink is approximately 2.4 times larger than that of said ink tank for said high density ink.

12. An ink jet cartridge according to claim 9, wherein the second ink is discharged to overlap onto the first ink before the first ink is absorbed into the recording medium.

13. An ink jet recording apparatus, comprising:

plural recording heads corresponding to each of at least black, cyan, magenta and yellow inks, and a carriage on which said plural recording heads are movably mounted to execute recording, wherein each of said plural recording heads comprises a plurality of nozzle arrays, each nozzle array having a plurality of nozzles arranged in an array along a first direction, said plurality of nozzle arrays being arranged along a second direction substantially perpendicular to the first direction, wherein each of said recording heads discharges at least two kinds of ink including a first density ink and a second density ink, the second density ink having a density which is relatively lower than the first density ink, and wherein the first density ink and the second density ink are always discharged and overlapped to record in a sequence of said first density ink and then said second density ink with respect to the second direction.

14. An ink jet recording apparatus according to claim 13, wherein the plural recording heads are adjacently positioned and integrally formed with each other.

15. An ink jet recording apparatus according to claim 13, wherein the second ink is discharged to overlap onto the first ink before the first ink is absorbed into the recording medium.

* * * * *